United States Patent [19]

Fuchs

[11] Patent Number: 4,697,412

[45] Date of Patent: Oct. 6, 1987

[54] APPARATUS FOR MAKING A YARN

[75] Inventor: Helmut Fuchs, Linz, Austria

[73] Assignee: Textilmaschinenfabrik Dr. Ernst Fehrer Aktiengesellschaft, Leonding, Austria

[21] Appl. No.: 912,312

[22] Filed: Sep. 29, 1986

[30] Foreign Application Priority Data

Nov. 4, 1985 [AT] Austria ..... 3163/85

[51] Int. Cl.[4] ..... D01H 7/898

[52] U.S. Cl. ..... 57/401

[58] Field of Search ..... 57/400, 401, 408, 405

[56] References Cited

U.S. PATENT DOCUMENTS

| | | | |
|---|---|---|---|
| 4,107,909 | 8/1978 | Fehrer et al. | 57/401 |
| 4,109,454 | 8/1978 | Fehrer et al. | 57/401 |
| 4,168,601 | 9/1979 | Didek et al. | 57/401 |
| 4,241,571 | 12/1980 | Turk et al. | 57/411 X |
| 4,367,623 | 1/1983 | Parker et al. | 57/401 X |
| 4,537,021 | 8/1985 | Parker | 57/401 |
| 4,539,806 | 9/1985 | Stahlecker | 57/400 |
| 4,570,434 | 2/1986 | Stahlecker | 57/408 X |

FOREIGN PATENT DOCUMENTS

| | | |
|---|---|---|
| 3322394 | 1/1985 | Fed. Rep. of Germany . |
| 3323988 | 1/1985 | Fed. Rep. of Germany . |

*Primary Examiner*—Donald Watkins

*Attorney, Agent, or Firm*—Kurt Kelman

[57] ABSTRACT

Apparatus for making a yarn comprises two juxtaposed, closely spaced apart twisting drums, which rotate in the same sense about parallel axes and at least one of which has a suction zone, which faces the generally triangular twisting space defined by said twisting drums between them. A fiber-guiding passage extends into said generally triangular twisting space at an oblique angle to the axes of said twisting drums and has an outlet opening, which extends along said axes and serves to supply fibers which are to be twisted together to form a yarn. In order to increase the strength of the yarn, each suction zone is enlarged in width adjacent to one end of the outlet opening of the fiber-guiding passage.

1 Claim, 2 Drawing Figures

2
12
1
10
3
4
6
11
II
II
9
7
5
8

APPARATUS FOR MAKING A YARN

BACKGROUND OF THE INVENTION

1. Field of the Invention

This invention relates to apparatus for making a yarn, comprising two juxtaposed, closely spaced apart twisting drums, which rotate in the same sense about parallel axes and at least one of which has a suction zone which faces the generally triangular twisting space defined between the twisting drums, and a fiber-guiding passage extending into said generally triangular twisting space at an oblique angle to the axes of said twisting drums and having an outlet opening which extends parallel to said axes and serves to supply fibers which are to be twisted together to form a yarn.

2. Description of the Prior Art

It is known that a yarn can be made in a process in which singled fibers are supplied through a fiber-guiding passage into a generally triangular twisting space between two twisting drums while a vacuum is applied through the peripheries of said drums to said triangular space so that the air is sucked from said fiber-guiding passage through said triangular space and the individual fibers are substantially parallelized by the air stream in the fiber-guiding passage. The twisting of the singled fibers will be improved if the singled fibers extend approximately in the direction in which the yarn is withdrawn. That orientation will be obtained if the fiber-guiding passage extends at an acute angle to the direction in which the yarn is withdrawn from the generally triangular twisting space either in the sense in which the fibers are supplied to said space or in the opposite sense. If the fibers are supplied to the triangular space through the fiber-guiding passage in the sense in which the yarn is withdrawn from said space, the opration can be described as forward twisting. If the fibers are supplied to said triangular space in a sense which is opposite to the direction in which the yarn is withdrawn from said space, the operation can be described as reverse twisting. In the latter case the fiber-guiding passage has relative to the direction of yarn withdrawal an inclination which is opposite to its inclination during forward twisting. Even though it is desired to orient the fibers approximately parallel to the line of yarn formation the yarns which consist of the fibers that have been twisted together do not always meet high requirements regarding strength and wear resistance and from that aspect it does not make a difference whether the yarn has been made by forward twisting or by reverse twisting.

SUMMARY OF THE INVENTION

It is an object of the invention so to improve an apparatus of the kind described first hereinbefore which serves to make a yarn and is of the kind described first hereinbefore that yarns of higher quality, particularly of higher tenacity, can be made, and to accomplish this with simple means.

The object set forth is accomplished in accordance with the invention in that the suction zone is enlarged in width adjacent to one of the two ends of the outlet opening of the fiber-guiding passage.

Because the suction zone is enlarged in width adjacent to one end portion of the outlet opening of the fiber-guiding passage, the air is caused to flow adjacent to said one end at a higher rate per unit of length of said outlet opening and at a higher velocity so that the fibers entrained by said air into the generally triangular space adjacent to said one end will extend at a larger angle to the direction in which the yarn is withdrawn than the remaining fibers. If the suction zone is enlarged adjacent to that end of the outlet opening of the fiber-guiding passage which is nearer to the delivery end of the triangular space, those fibers which are entrained by the air flowing at a higher velocity will constitute the covering fibers of the yarn being formed, whether that yarn is made by forward or reverse twisting. Those fibers which are supplied to the outlet opening of the fiber-guiding passage adjacent to that end of said opening which is remote from the delivery end of the triangular space will constitute the core fibers of the yarn. The covering fibers entering at a larger angle will be wound around said core fibers at a helix angle which is smaller than that of the core fibers so that the cohesion of the core fibers can be greatly improved by the covering fibers, which have been wound at a smaller helix angle. This will necessarily result in a yarn having a higher tenacity and a higher wear resistance. That winding effect can be controlled by the extent to which the suction zone is enlarged in width because the fibers will be aligned with the flow lines so that a flow of air at a higher velocity will result in a larger angle between the fibers and the direction of yarn withdrawal.

DETAILED DESCRIPTION OF THE PREFERRED EMBODIMENT

Figure 1:
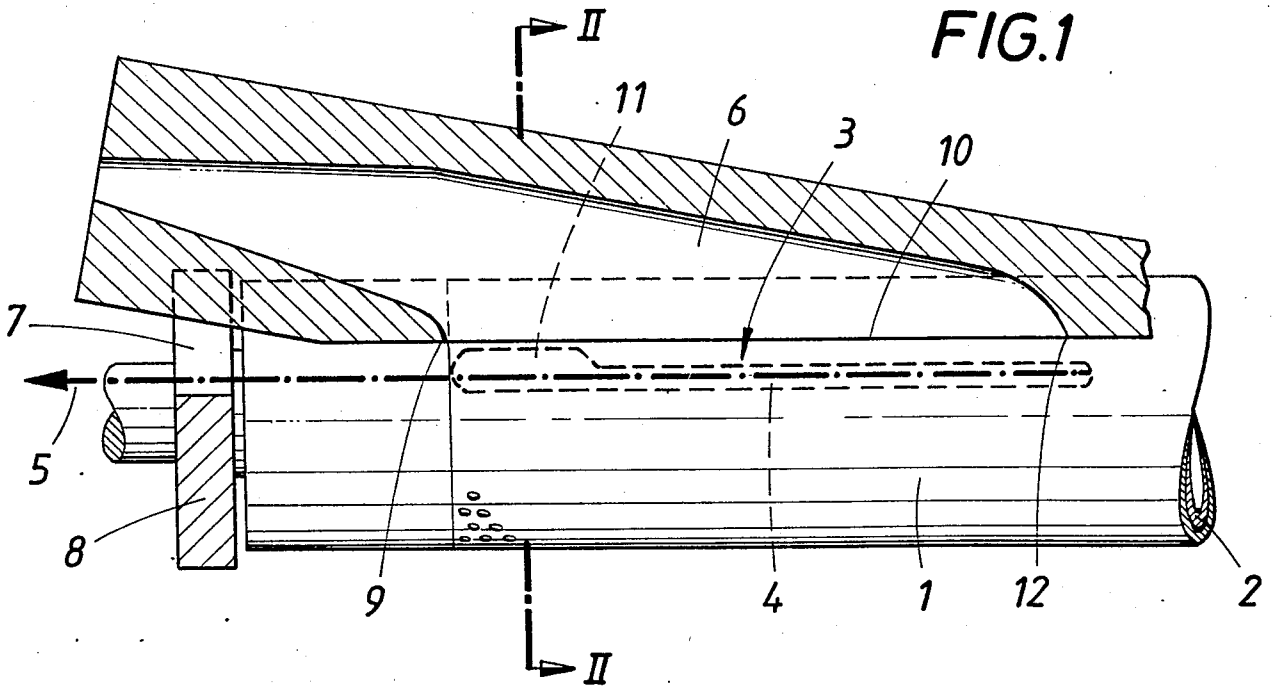
FIG. 1 is a simplified vertical sectional view taken on a plane which extends through the fiber-guiding passage and shows apparatus in accordance with the invention for making a yarn.
Figure 2:
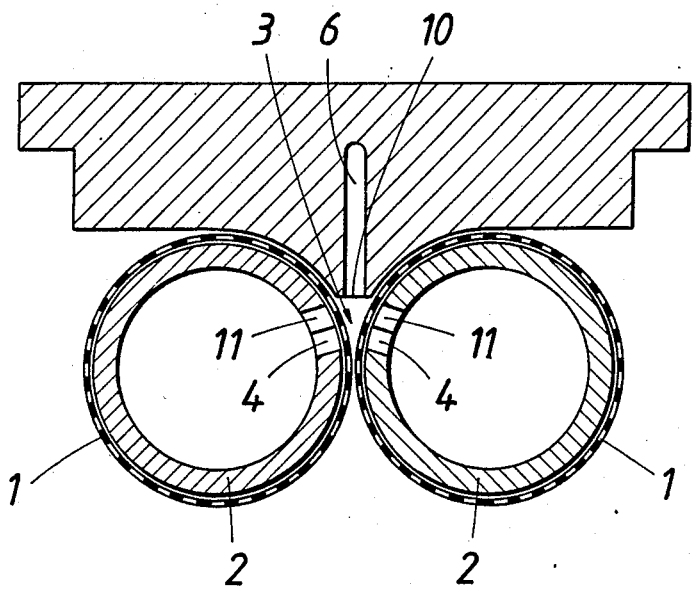
FIG. 2 is a sectional view taken on line II—II in FIG. 1.

The illustrated apparatus comprises two juxtaposed twisting drums 1, which are closely spaced apart and rotate in the same sense about parallel axes. Each drum contains a suction insert 2 which defines a suction zone 4 extending parallel to the axis of the drum on its periphery and facing the generally triangular twisting space 3 defined by the drums 1. The suction zones 4 will cause the singled fibers which have entered the triangular space 3 to be sucked toward the nip between the drums 1 and to be twisted together in the nip to form a yarn, which can be axially withdrawn in the direction of yarn withdrawal indicated by the arrow 5. In the present embodiment that direction is opposite to the sense in which the fibers are supplied to the triangular space 3.

Singled fibers are supplied to the space 3 through a fiber-guiding passage 6, which extends into the triangular space 3 and is inclined relative to the direction of yarn withdrawal 5. That inclination of the fiber-guiding passage 6 has been adopted to ensure that the individual fibers entering the triangular space will extend only at a small angle to the direction of yarn withdrawal 5 so that the fibers can be effectively twisted together to form a yarn. Singled fibers are delivered to the fiber-guiding passage 6 from an opener, which is not shown. The desired orientation of the singled fibers is assisted by an axially directed air stream, which is sucked by an ejector through a suitable aperture 7 in a mounting plate 8 disposed at one end of the triangular space 3.

As is particularly apparent from FIG. 1, the suction zone 4 is enlarged in width at 11 adjacent to that end 9 of the outlet opening 10 of fiber-guiding passage 6, which is nearer to the delivery end of the triangular space 3. As a result, air is sucked from the fiber-guiding passage at a higher rate and at a higher velocity adjacent to the end 9 of the outlet opening 10 so that the fibers entering the triangular space adjacent to the end 9 will extend at a larger angle to the direction of yarn withdrawal 5. These fibers will form covering fibers in the yarn being made. The fibers entering the triangular space 3 at that end 12 of the outlet opening 10 which is remote from the delivery end of the triangular space 3 will constitute the core fibers of the yarn. Owing to the large inclination of the covering fibers entering the triangular space 3 at the end 9, the covering fibers will be wound around the core fibers at a smaller helix angle than the latter and will more strongly hold the core fibers together. A yarn which comprises core fibers and covering fibers having different helix angles will have a high tenacity and a high wear resistance.

This is applicable not only to yarns made by reverse twisting, which has been illustrated, but also to yarns made by a forward twisting operation, in which the yarn is withdrawn in a direction which is opposite to the arrow 5. In such case a yarn consisting of core fibers and of covering fibers which are wound around the core fibers at a smaller helix angle than the latter will be obtained if the portion 11 in which the suction zone 4 is enlarged in width is disposed at that end 12 of the outlet opening 10 of the fiber-guiding passage 6 which is nearer to the delivery end of the triangular space 3.

If only the direction of yarn withdrawal is changed in the embodiment shown on the drawing, the enlarged portion 11 which is disposed adjacent to that end 9 of the outlet opening 10 which is then remote from the delivery end of the triangular space 3 will cause the core fibers to enter the triangular space at a larger angle to the direction of yarn withdrawal and said core fibers will be distributed over a smaller axial length. This will result in a yarn which has a more uniform structure and owing to the different helix angles of the core fibers and covering fibers has also a higher strength.

I claim:

1. An apparatus for making a yarn, comprising (a) two juxtaposed twisting drums, which are closely spaced apart and adapted to be rotated about parallel axes in the same sense, the twisting drums defining therebetween a generally triangular twisting space extending parallel to the axes, (b) means defining a fiber-guiding passage extending into the triangular twisting space at an oblique angle to the drum axes, the fiber-guiding passage having an elongate outlet opening extending in, and along, the triangular twisting space parallel to the axes, and the elongated outlet opening having opposite ends, and (c) suction means defining an elongate suction zone on the periphery of at least one of the twisting drums, the suction zone opening into the triangular space, facing the elongated outlet opening of the fiber-guiding passage and extending parallel to the axes, and the elongate suction zone having an enlarged width adjacent one of the outlet opening ends.

* * * * *